US010887704B2

(12) United States Patent
As'Ad et al.

(10) Patent No.: US 10,887,704 B2
(45) Date of Patent: Jan. 5, 2021

(54) METHOD FOR BEAMFORMING IN A BINAURAL HEARING AID

(71) Applicant: SIVANTOS PTE. LTD., Singapore (SG)

(72) Inventors: Hala As'Ad, Nepean (CA); Martin Bouchard, Cantley (CA); Homayoun Kamkar-Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/673,045

(22) Filed: Nov. 4, 2019

(65) Prior Publication Data

US 2020/0204927 A1 Jun. 25, 2020

(30) Foreign Application Priority Data

Dec. 21, 2018 (EP) ..... 18215514

(51) Int. Cl.
*H04R 25/00* (2006.01)
*H04R 3/00* (2006.01)

(52) U.S. Cl.
CPC ..... *H04R 25/407* (2013.01); *H04R 25/405* (2013.01); *H04R 25/552* (2013.01)

(58) Field of Classification Search
CPC .. H04R 3/005; H04R 25/552; H04R 2225/41; H04R 2430/20; H04R 2430/23;
(Continued)

(56) References Cited

U.S. PATENT DOCUMENTS 8,204,263 B2 6/2012 Pedersen et al.
2013/0272548 A1* 10/2013 Visser ..... G06K 9/4671 381/122

(Continued)

FOREIGN PATENT DOCUMENTS

EP 2088802 A1 8/2009
EP 3383067 A1 10/2018

OTHER PUBLICATIONS

Daoud Mohammad I et al: "In-house alert sounds detection and direction of arrival estimation to assist people with hearing difficulties", 2015 IEEE/ACIS 14th International Conference on Computer and Information Science (ICIS), IEEE, Jun. 28, 2015 (Jun. 28, 2015), pp. 297-302, XP033181863.

(Continued)

*Primary Examiner* — George C Monikang
(74) *Attorney, Agent, or Firm* — Laurence A. Greenberg; Werner H. Stemer; Ralph E. Locher

(57) ABSTRACT

The invention discloses a method for noise reduction in a binaural hearing aid, said binaural hearing aid comprising a first local unit and a second local unit, wherein the method comprises the following steps: generating a first main signal and a first auxiliary signal in the first local unit from an environment sound, and a second main signal in the second local unit from the environment sound, estimating a direction of arrival of a useful sound signal in the environment sound, assigning a first frequency range and a second frequency range, generating a first range beamformer signal in the first frequency range from the first main signal, the first auxiliary signal and the second main signal by imposing at least one spatial condition related to the estimated direction of arrival on the directional characteristic of the first range beamformer signal, generating a second range beamformer signal in the second frequency range from the first main signal and the second main signal by imposing at least one spatial condition related to the estimated direction of arrival on the directional characteristic of the second range beamformer signal, and generating a first local output signal from the first range beamformer signal and the second range beamformer signal, wherein the first local output signal is transduced into a first output sound by a first output transducer of the first local unit.

19 Claims, 2 Drawing Sheets

Figure 1:
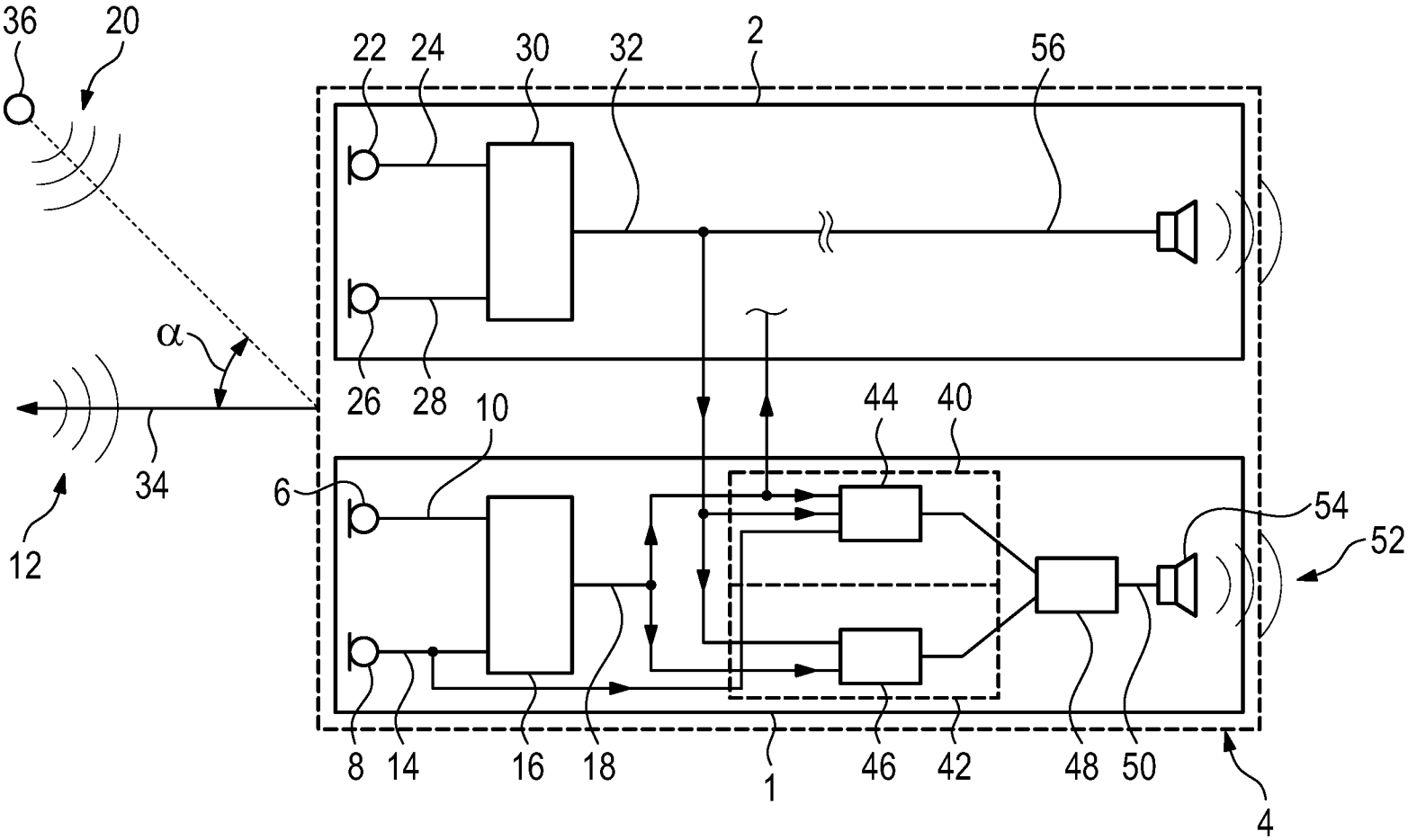

(58) Field of Classification Search
CPC ..... H04R 2201/40; H04R 2203/12; G10L 2021/02166
USPC ..... 381/92, 122, 310, 312–313
See application file for complete search history.

(56) References Cited

U.S. PATENT DOCUMENTS

2015/0289065 A1* 10/2015 Jensen ..... H04R 25/405 381/315
2018/0288535 A1 10/2018 De Vries et al.

OTHER PUBLICATIONS

Hala As'Ad et al: "A Robust Binaural Linearly Constrained Minimum Variance with Spatial Cues Preservation for Hearing Aids Beamforming",arxiv.org, Cornell University Library, 201 OLIN Library Cornell University Ithaca, NY 14853, Nov. 3, 2018 (Nov. 3, 2018), XP081045530.
Seung Woo Yu et al: "Audio Engineering Society Convention Paper Direction of Arrival Estimation of Multiple Sound Sources Based on Frequency-Domain Minimum Variance Distortionless Response Beamforming", May 10, 2015 (May 10, 2015), XP055595141, Retrieved from the Internet: URL:http: www.aes.orgje-lib/instjdownload .cfm/17723.pdf?ID=17723 [retrieved on Jun. 7, 2019].
As'Ad Hala et al: "Binaural beamforming with spatial cues preservation for hearing aids in real-life complex acoustic environments", 2017 Asia-Pacific Signal and Information Processing Association Annual Summit and Conference (APSIPA ASC), IEEE, Dec. 12, 2017 (Dec. 12, 2017), pp. 1390-1399, XP033315634.

* cited by examiner

METHOD FOR BEAMFORMING IN A BINAURAL HEARING AID

The invention is related to a method for beamforming in a binaural hearing aid comprising a first local unit and a second local unit, wherein the method comprises the steps of generating a first main signal and a first auxiliary signal in the first local unit from an environment sound, and a second main signal in the second local unit from the environment sound, and generating a first local output signal from the first main signal, the second main signal and the first auxiliary signal, wherein the first local output signal is transduced into a first output sound by a first output transducer of the first local unit.

In hearing aids, the importance of noise reduction of an input signal is ubiquitous. A hearing impaired person as a user of a hearing aid typically has challenges in hearing certain frequency bands. Very often, the hearing ability is particularly reduced in the higher frequency bands where formants relevant for speech understanding are located, so that the understanding of speech is an important issue for a hearing aid user. In particular, in this context, a hearing aid user may benefit from noise reduction, leading to an increase in the signal-to-noise-ratio (SNR). In recent times, noise reduction by beamforming techniques has become essential for increasing the SNR in a hearing aid. The advantage of beamforming techniques is that a "team", i. e. the sensitivity of a microphone array can be pointed towards the direction of a source of a useful signal, attenuating thereby sounds from other directions which are assumed to be noise.

While initially it was only possible to point the beam in a frontal direction of the hearing aid user, assuming that the user is looking towards the source of the useful sound signal, now also beams in other directions are feasible, especially in the case of binaural beamforming in a binaural hearing aid with two local units, each of which comprising more than just one microphone. Thus, at least two input signals are generated in each local unit, so that very advanced microphone arrays may be constructed from all of the input signals.

One major problem with beamforming techniques is that the noise reduction is working properly only if the beam truly points towards the source of the useful sound signal. However, the estimation of the so-called "direction of arrival" (DOA) of the useful signal (i.e., a desired target source signal) may contain errors, especially in case of a speech signal with speaking pauses over an acoustically complex noisy background. Furthermore, small natural head movements of the hearing aid user during conversation as normal gestures of communication may lead to deviations that an estimation of the DOA only can follow with a time lag, or the DOA is not accurate enough for small deviations. Even though these deviations typically only occur in a small angular range, as a consequence, the useful signal gets attenuated and noise contributions get slightly enhanced (i.e. less reduction), leading to a worse SNR improvement.

There exist noise reduction approaches using beamforming which are more robust against errors in the estimation of the DOA, such as generalized side lobe canceler algorithms with adaptive blocking matrixes or an adaptive estimation of the DOA in combination with steerable binaural beamformers. However, the generalized side lobe canceler approach does not perform too well for isotropic ambient noise. The cited methods may be adapted to the situation where isotropic ambient noise and directional interferers are present, this however requires the calculation of a sound-source presence probability, increasing the calculation overhead.

But also, a sound source presence probability would need to differentiate between sounds emergind from the useful signal source and from directional interferers. This is quite difficult in practice.

It is therefore the object of the present invention to provide a method to increase the rubustness of a beamformer in a binaural hearing aid which is particularly robust against smaller or moderate errors in the estimation of the DOA of a target signal.

According to the invention, this object is achieved by a method for beamforming in a binaural hearing aid, said binaural hearing aid comprising a first local unit and a second local unit, wherein the method comprises the following steps: generating a first main signal and a first auxiliary signal in the first local unit from an environment sound, and a second main signal in the second local unit from the environment sound, estimating a direction of arrival of a useful sound signal in the environment sound, assigning a first frequency range and a second frequency range, generating a first range beamformer signal in the first frequency range from the first main signal, the first auxiliary signal and the second main signal by imposing at least one, preferably at least two spatial conditions related to the estimated direction of arrival on the directional characteristic of the first range beamformer signal, generating a second range beamformer signal in the second frequency range from the first main signal and the second main signal by imposing at least one spatial condition related to the estimated direction of arrival on the directional characteristic of the second range beamformer signal, and deriving a first local output signal from the first range beamformer signal and the second range beamformer signal, wherein the first local output signal is transduced into a first output sound by a first output transducer of the first local unit. Embodiments which show particular advantages and may be inventive in their own respect are given by the dependent claims as well as in the subsequent description.

In particular, the first local unit and the second local unit, respectively, are to be worn by the hearing aid user on his left year and on his right ear, respectively. In this respect, the first local unit may be given either by the local unit one at the left year of the user of the binaural hearing aid, or by the unit one at the right ear of the user. Each of the first and the second local unit comprises at least one input transducer for converting the environment sound into an electric input signal. In particular, each of the first and the second local unit may comprise at least two input transducers so that in each of the local units, two different input signals are generated from the environment sound by the respective input transducers.

In particular, the first main signal may be derived directly, i.e., without signal contributions from another signal, from a first input signal in the first local unit, generated there by a first input transducer. As an alternative, the first main signal may be derived from two local signals generated by two different input transducers in the first local unit, respectively. For example, the first local unit may comprise a front input transducer and a rear input transducer, generating from the environment sound a front input signal and a rear input signal, respectively, and the first main signal may contain signal contributions from these two signals, possibly after some pre-processing, such as frequency-dependent gain adjustment. Similar conditions may hold for the second main signal generated in the second local unit. Preferably, the number of input signals in the first local unit used for deriving the first main signal corresponds to the number of input signals in the second local unit used to derive the second main signal. Most preferably, the algorithms to generate the first main signal and the second main signal from the respective input signals are consistent to each other. This comprises that if the first man signal is generated from two input signals in the first local unit by sum-and-delay beamforming, then the second main signal is generated in the second local unit from two input signals also by a sum-and-delay process.

Preferably, the first auxiliary signal is generated in the first local unit in a different way than the first main signal. This comprises deriving the first auxiliary signal directly from one single input signal of the first local unit, in case that the first main signal is derived from at least two input signals. Likewise, the first auxiliary signal may be generated from at least two input signals—one of which possibly transmitted from the second local unit towards the first local unit—if the first man signal is derived from only one input signal of the first local unit.

The DOA of a useful sound signal may in particular be estimated using one of the first man signal, the first auxiliary signal, and the second main signal, and/or the respective underlying input signals of the first local unit and/or the second local unit. This estimation may be carried out by techniques known in the art, for example using the signal power of possible useful signals from different directions, or also by making specific assumptions on the nature of the useful sound signal (e.g. the assumption of the useful sound signal being speech).

In particular, the first range beamformer signal is generated from the first main signal, the first auxiliary signal and the second main signal in the first frequency range by imposing at least two spatial conditions related to the estimated direction of arrival. In this respect, the generation of the first range beamformer signal may treat the first man signal, the first auxiliary signal and the second man signal as some sort of an array, e.g., by solving a constrained-based equation array, where the resulting first range beamformer signal shows a directional characteristic which has two fulfill the imposed spatial conditions which are related to the estimated DOA. For example, the first range beamformer signal may be generated as a weighted superposition of the three mentioned component signals, while the spatial conditions related to the estimated DOA, which are imposed on the directional characteristic of the resulting first range beamformer signal, may be given as a pair of attenuation values in the directional characteristics, i. e., two respective sensitivity values for the resulting beamforming, in a respective certain angular distance from the DOA. This means that for an estimated DOA, there are given two specific angular distances, preferably one small positive angular distance and one small negative angular distance spanning some sort of a wedge in the DOA, and at the two edges of said wedge, the sensitivity of the resulting beamforming is fixed as the imposed conditions.

Likewise, the second range beamformer signal may be generated in the second frequency range from the first main signal and the second main signal by imposing at least one, preferably exactly one spatial condition on the directional characteristic of the resulting second range beamformer signal, and thus, on the resulting beamformer. Accordingly, said spatial condition may be given as a specific attenuation or sensitivity value for the directional characteristic at a specific angular distance from the DOA.

The first local output signal may be generated from the first range beamformer signal and the second range beamformer signal taking these two signals directly, e.g., as a superposition, or generated from the first and second range beamformer signals an intermediate signal, to which further hearing aid specific signal processing, such as frequency dependent gain factors, but also feedback suppression may be applied prior to transducing the first local output signal into the first output sound. For the present invention, an output transducer may in particular be given by an electrical-acoustic transducer configured to convert and electric signal into sound, in particular by means of mechanical vibrations stimulated by the electrical signal. Likewise, and input transducer is in particular given by an electro-acoustic transducer configured to convert the environment sound into and electric input signal, e.g. a microphone.

The assignment of a first frequency range and a second frequency range, and the generation of the first range beamformer signal and the second range beamformer signal, respectively, allows for a frequency dependent treatment of the underlying noise reduction problem. In particular, the second frequency range is assigned to that set or range of frequencies in which due to physical reasons, for a given DOA the directionality of the sound signal is less pronounced anyway, and thus, smaller or moderate errors in the estimation of the DOA lead also to less attenuation of the useful signal and less enhancement of the noise components, respectively, due to the lower directionality. To this end, and in a situation of a lower directionality of the assumed useful signal, a construction of the second range beamformer signal from two underlying signals, given here in form of the two main signals from two local units, is considered to be sufficient with respect to the spatial resolution and minimizing resources and CPU time.

On the other hand, for frequencies at which the useful signal is assumed to be more directed, the respective beamforming signal, generated as the first range beamformer signal, takes into account one additional signal in form of the first auxiliary signal, thus increasing the spatial resolution possibility, and allowing for the imposition of a second condition of the resulting first range beamformer signal. So in a resource-efficient way, a higher spatial resolution in the process of beamforming is only applied in the frequency range where due to an increased directionality of the useful signal this may lead to substantial differences. As the frequency-dependent directionality patterns may vary for different DOAs, the assignment of the two frequency ranges in dependence of the DOA as estimated may make the proposed method particularly robust against smaller or moderate errors in the estimation process for the DOA.

It may be particularly advantageous to perform the method in a symmetrical way for the two local units, i.e., assign the two frequency ranges, use the two main signals to locally generate a second range beamformer signal on each side, i.e., in each unit, further take a first auxiliary signal for locally generating a first range beamformer signal in the first local unit, and a second auxiliary signal for locally generating a first range beamformer signal in the second local unit, and generate respective first and second output signals in the first and second unit from the locally generated first range and second range beamformer signals. However, even though beneficial, such a symmetrical implementation is not always necessary for a DOA-robust noise reduction beamforming: in case that the DOA has a substantial angular distance to the frontal direction of the user, e.g., more than +/−45°, one of the local units is substantially "closer" to the useful signal source (especially in terms of interaural loudness difference). Thus, the method performed in this local unit will already lead to positive results regarding both noise reduction and robustness against small and moderate DOA estimation errors, while the other local unit may or may not implement the same method in a symmetrical way as described above.

Preferably, in order to generate the first range beamformer signal, a first attenuation value at a first angular distance from the estimated direction of arrival and a second attenuation value at a second angular distance from the estimated direction of arrival are given as the at least one spatial condition on the directional characteristic of the first range beamformer signal. This means that two spatial conditions related to the estimated DOA are imposed on the directional characteristic of the resulting first range beamformer signal, and these two spatial conditions are imposed in the form of fixing the attenuation by a respective attenuation value for two different angles from the DOA. The attenuation value then shall indicate the sensitivity of the beamformer that forms the first range beamformer signal in the indicated angular direction. For scaling this attenuation value, preferably no further signal processing apart from the beamformer itself (such as frequency-dependent amplification and the like) shall be taken into account, in order to have only the spatial characteristics of the beamformer as variables.

Advantageously, the first attenuation value and the second attenuation value are set such that in a first angular range given from 3° to 10° with respect to the estimated direction of arrival, there exists a first angle with an attenuation of less than 0.5 dB, and in a second angular range given from −3° to −10° with respect to the estimated direction of arrival, exists a second angle with an attenuation of less than 0.5 dB. This means in particular: the spatial conditions may be set by giving the first angle $\phi\mathbf{1}$ in the range of [3°, 10°] with respect to the DOA, giving the second angle $\phi\mathbf{2}$ in the range of [−10°, −3°] with respect to the DOA, and setting the attenuation values a1, a2 at the first and the second angle $\phi\mathbf{1}$, $\phi\mathbf{2}$ in an interval [0 dB, 0.5 dB], e.g., a1=0 dB, a2=0 dB.

Also, there are alternative and equivalent ways of formulating these two spatial conditions, leading to the same result of having at least one angle $\phi\mathbf{1}\in[3°, 10°]$ where the attenuation is giveby a value a1∈[0 dB, 0.5 dB], and least one angle $\phi\mathbf{2}\in[-10°, 3°]$ (with respect to the DOA) where the attenuation is given by a value a2∈[0 dB, 0.5 dB]. Technically, the two conditions may be used to set the attenuation, preferably close to 0 dB, for two angles enclosing the DOA. Then, for the DOA itself, there will still be no perceivable attenuation, while the angular range for which no "real", perceivable attenuation occurs, is broadened up by the first angle and the second angle, in the first frequency range. To this end, the first frequency range is preferably assigned as the frequencies in which the assumed useful signal shows a higher directionality than in the second frequency range.

Preferably, in order to generate the second range beamformer signal, a third attenuation value at a third angular distance from the estimated direction of is given as the at least one spatial condition on the directional characteristic of the second range beamformer signal. This means that one spatial condition related to the estimated DOA is imposed on the directional characteristic of the resulting second range beamformer signal, and this spatial condition is imposed in the form of fixing the attenuation by a respective attenuation value for a given angle related DOA. The attenuation value then shall indicate the sensitivity of the beamformer that forms the second range beamformer signal in the indicated angular direction. For scaling this attenuation value, preferably no further signal processing apart from the beamformer itself (such as frequency-dependent amplification and the like) shall be taken into account, in order to have only the spatial characteristics of the beamformer as variables. In particular, the third angular distance may be set to zero such that the third angle coincides with the estimated DOA.

Advantageously, the third attenuation value is set such that in a third angular range given from −2° to 2° with respect to the estimated direction of arrival, there exists a third angle with an attenuation of less than 0.5 dB. This means in particular: the spatial condition may be set by giving the third angle $\phi\mathbf{3}$ in the range of [−2°, 2° ] with respect to the DOA, and setting the attenuation value a3 at the third angle $\phi\mathbf{3}$ in an interval [0 dB, 0.5 dB], e.g., a3=0 dB.

Also, there are alternative and equivalent ways of formulating this spatial condition, leading to the same result of having at least one angle $\phi\mathbf{3}\in[-2°, 2°]$ (with respect to the DOA) where the attenuation is given by a value a3∈[0 dB, 0.5 dB]. Technically, this condition may be used to set the attenuation, preferably close to 0 dB, for the DOA itself. To this end, the second frequency range is preferably assigned as the frequencies in which the assumed useful signal shows a lower directionality than in the first frequency range. Then, for the DOA itself and also for a small angular range about the DOA, there will still be no perceivable attenuation, while said angular range for which no "real", perceivable attenuation occurs, is broadened up by due to the relatively low directivity of the sound in the second frequency range.

In an embodiment, the first frequency range and the second frequency range are assigned in dependence of the estimated DOA. With the two local units, a binaural hearing aid defines a non-isotropic a-priori-structure on the surrounding acoustic space. The two local units, when worn by a user at his ears, together with shadowing effects of the head of the user, define a frontal direction of preference, as well as lateral directions. In real situations, the directionality patterns of acoustic signals impinging on the binaural hearing aid may vary largely in frequency in dependence of the DOA with respect to the frontal direction of the binaural hearing aid. For a well-defined useful sound signal with a DOA in some angular range of up to +/−45° or even +/−60° about the frontal direction, typically the directionality is more pronounced in frequency ranges above 1500 Hz, while below this frequency, the directionality of the sound is less strong.

This means that a small deviation of 5-10° from an estimated DOA in a noise reduction beamformer due to estimation errors may lead to audible distortions in the output signal in the upper frequency range, while in the lower frequency range, such deviations might hardly have any perceivable consequences on the binaurally noise-reduced output. However, this relation gets inverted for fully lateral signals and signals from a lateral direction up to +/−15° (i.e., angles above 75° with respect to the frontal direction), where the head shadowing effects lead to a high directionality in low frequency ranges up to 500 Hz, and less developed directionality of the sound signals above this frequency range. Obviously, the transitions between the given angle and frequency ranges are smooth, and may in particular vary in dependence of the individual users head and ears' anatomy. Assigning the bandwidth and frequency location of both the first frequency range—the one with a higher direction-sensitive treatment—and the second frequency range—with a more direction-robust treatment—in dependence of an estimated DOA allows for taking into account these effects.

Preferably, for the direction of arrival being estimated in an angular range from a negative aperture angle to a positive aperture angle, each of which are defined with respect to a frontal direction that is defined by the positions of the first local unit and the second local unit, a first crossover frequency is assigned, the first frequency range is assigned as the frequency range above the first crossover frequency and the second frequency range is assigned as the frequency range below the first crossover frequency. This allows for an easy implementation that respects the observed directionality effects explained above. Preferably, the negative aperture angle is chosen from an angular range of [−85°, −65°], and the positive aperture angle is chosen from an angular range of [65°, 85°].

In an embodiment, the first crossover frequency is assigned as a frequency between 250 kHz and 2 kHz, preferably between 1 Hz and 2 kHz. This takes into account both the frequency range in which directional effects may start for essentially frontal useful sound signals and the possible variations of the frequencies due to the individual anatomy of the user.

Preferably, for the direction of arrival being estimated in an angular range of twice the complementary angle to the positive aperture angle around a lateral direction defined by the positions of the first local unit and the second local unit, a second crossover frequency is assigned, the first frequency range is assigned as the frequency range below the second crossover frequency and the second frequency range is assigned as the frequency range above the second crossover frequency. This means that if the positive aperture angle is given by $\beta$, then if the DOA is estimated in an angular range of $90°+/-|90°-\beta|$ or in an angular range of $-90°+/-|90°-\beta|$, then a second crossover frequency is assigned, and the useful signal is taken to be a lateral signal such that the first frequency range is assigned to be below the second crossover frequency, while the second frequency range is assigned to be above the second crossover frequency. This allows for an easy implementation that respects the observed directionality effects explained above.

In an embodiment, the second crossover frequency is assigned as a frequency between 250 Hz and 2 kHz, preferably between 250 Hz and 1 kHz. This takes into account both the frequency range in which directional effects may start for essentially frontal useful sound signals and the possible variations of the frequencies due to the individual anatomy of the user.

Preferably, in the first local unit, a first local front signal is generated from the environment sound by a first front input transducer, and a first local rear signal is generated from the environment sound by a first rear input transducer, and in the second local unit, a second local front signal is generated from the environment sound by a second front input transducer, and a second local rear signal is generated from the environment sound by a second rear input transducer. The first main signal then is generated from the first local front signal and the first local rear signal, and the second main signal is generated from the second local front signal and the second local rear signal, wherein the first auxiliary signal is generated either from the first local front signal or the first local rear signal. This allows for a local pre-processing of the sound signal at each local unit.

The first main signal and the second main signal each may be designed a local beamformer signal to have an increased sensitivity in the frontal hemisphere, assuming that sound from the back hemisphere of the user is likely to be noise. This simplifies the noise reduction, as the SNR to start with may already be improved in the two main signals, compared to the underlying input signals. In the process of generating the first and second main signal, additional pre-processing such as frequency dependent compression and/or volume adjustment may be performed on each of the input signals used.

In an embodiment, in the first local unit a first spatial reference signal is generated from the first local front signal or the first main signal, wherein in the first frequency rage range, a first coherence parameter of the first range beamformer signal and the first spatial reference signal is calculated, and a first mixing parameter is derived from the first coherence parameter, wherein a first range output signal is generated by mixing the first range beamformer signal and the first spatial reference signal according to the first mixing parameter, and wherein the first local output signal in the first frequency range is generated from the a first range output signal. This helps to restore the binaural cues in the first frequency range. Preferably, a similar signal processing is performed in the second local unit.

In an additional or alternative or independent embodiment, in the first local unit a second spatial reference signal is generated from the first local front signal or the first main signal, wherein in the second frequency rage range, a second coherence parameter of the second range beamformer signal and the second spatial reference signal is calculated, and a second mixing parameter is derived from the second coherence parameter, wherein a second range output signal is generated by mixing the second range beamformer signal and the second spatial reference signal according to the second mixing parameter, and wherein the first local output signal in the second frequency range is generated from the a second range output signal. This helps to restore the binaural cues in the second frequency range. Preferably, a similar signal processing is performed in the second local unit.

The first and/or the second coherence parameter preferably is taken as the complex coherence function. For a relatively high coherence, the magnitude of the first/second range output signal can be taken with a higher contribution of the magnitude of the first/second spatial reference signal, as the degree of noise reduction is likely to be close to the degree of noise reduction in the respective beamformer signal. For a lower degree of coherence, the beamformer output most likely achieves a better noise reduction than the spatial reference signal, so the first/second range output signal may contain a higher contribution from the respective beamformer signal for a better noise reduction. The phase for the first/second range output signal may be taken as the phase of either the respective spatial reference signal or the beamformer signal. If the absolute value of the phase of the complex coherence function is small, the beamformer signal does preserve the spatial cues of the spatial reference signal very well, so the phase of the beamformer signal may be taken. If the absolute value of the phase of the complex coherence function is above a given threshold, the phase of the spatial reference signal may be taken.

In an embodiment, the first range beamformer signal is generated from the first main signal, the first auxiliary signal and the second main signal via a linear constraint minimum variance beamformer, and/or the second range beamformer signal is generated from the first main signal and the second main signal via a minimum variance distortionless response beamformer. These methods have proved to be particularly easy to implement and lead to very DOA-error robust output signals.

Another aspect of the invention is given by a binaural hearing aid, comprising a first local unit with at least a first input transducer for converting environment sound into at least one first input signal, and a second local unit with at least a second input transducer for converting the environment sound into at least one second input signal, and a signal processing unit configured to perform the method described above. The advantages of the proposed method for noise reduction in a binaural hearing aid and for its preferred embodiments can be transferred to the binaural hearing aid itself in a straight forward manner.

Figure 2:
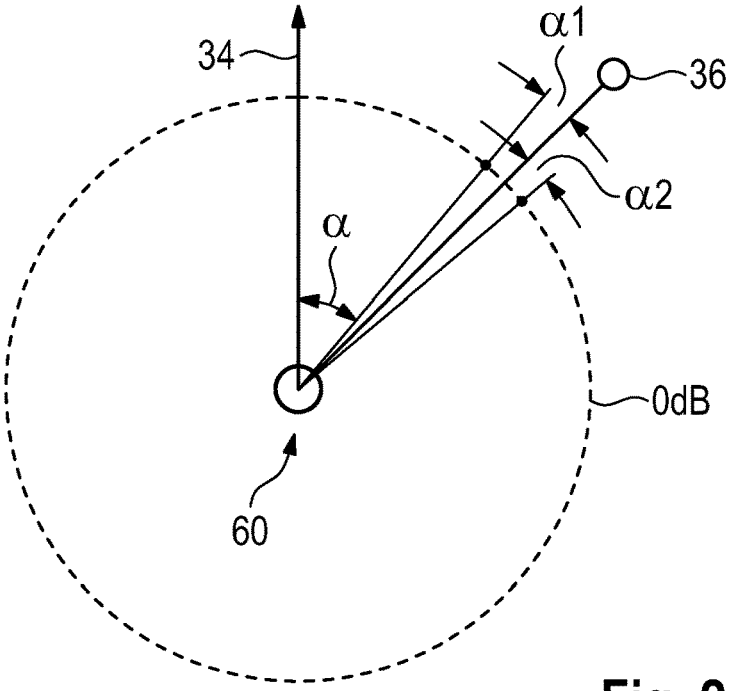
Figure 3:
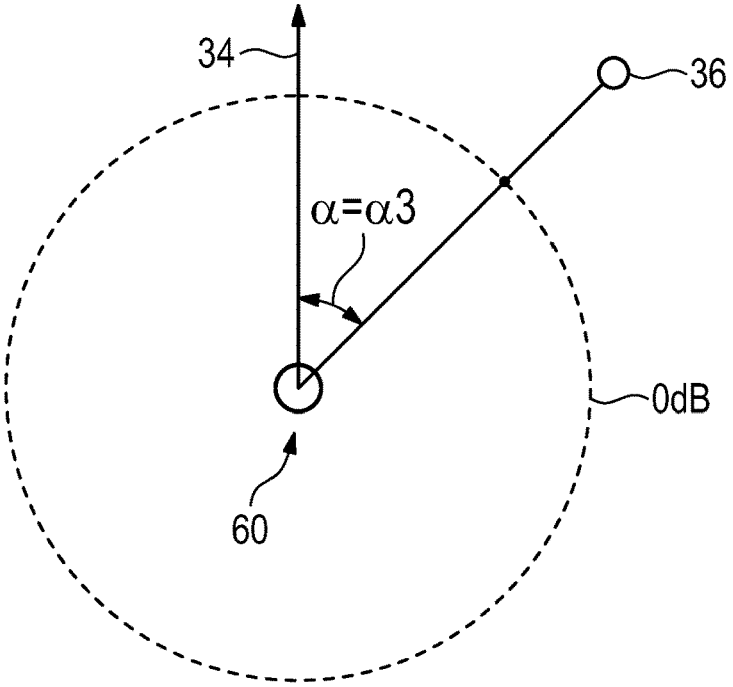

The attributes and properties as well as the advantages of the invention which have been described above are now illustrated with help of a drawing of an embodiment example. In detail, FIG. 1 shows a schematic block diagram of a binaural hearing aid with two local units performing a DOA-robust noise reduction with beamforming, FIG. 2 shows, in a schematical top view, two angular conditions for a beamformer signal in the first frequency range of the binaural hearing aid of FIG. 1, and FIG. 3 shows, in a schematical top view, one angular condition for a beamformer signal in the second frequency range of the binaural hearing aid of FIG. 1.

Parts and variables corresponding to one another are provided with in each case the same reference numerals in all figures.

FIG. 1 shows a schematic block diagram of a first local unit 1 and a second local unit 2, both of which form part of a binaural hearing aid 4. The first local unit 1 is to be worn by a user of the binaural hearing aid 4 at his left ear, while the second local unit 2 is to be worn by the user at his right ear in this embodiment. Different embodiments, where the user of the binaural hearing aid 4 is wearing the first local unit 1 at his right ear are possible. The first local unit 1 comprises a first front input transducer 6 and a first rear input transducer 8, both of which in the present embodiment are given by the respective microphones. The first front input transducer 6 generates a first local front signal 10 from an environment sound 12. The first rear input transducer 8 generates a first local rear signal 14 from the environment sound 12. A first local beamformer 16 generates a first main signal 18 from the first local front signal, 10, and the first local rear signal 14 by local beamforming techniques such as sum-and-delay methods, and possibly local pre-processing. In this sense, the first main signal 18, as being a beamforming signal, may already enhance a component of a useful signal 20 in the environment sound 12 compared to the noise components contained in the environment sound 12.

In a similar way, a second front input transducer 22 generates a second local front signal 24 from the environment sound 12, while a second rear input transducer 26 generates a second local rear signal 28 from the environment sound 12. Both the second front input transducer 22 and the second rear input transducer 26 are located in the second local unit 2, and may be given by respective microphones for the present embodiment. A second local beamformer 30 generates a second main signal 32 from the second local front signal 24, and the second local rear signal 28 by beamforming techniques similar to the ones used in the first local beamforming 16 of the first local unit 1.

As the first local unit 1 and the second local unit 2 are worn by the user of the binaural hearing aid 4 at his left and his right ear, respectively, they define a frontal direction 34 of the acoustic scene, via the symmetry of the first local unit 1 and the second local unit 2. The useful signal 20 in the environment sound 12, which for example, may be given by a speech signal from a speaker talking to the user of the binaural hearing aid 4, has a source 36, that is, the location of the speaker, forming an angle alpha with respect to the frontal direction 34. The angle alpha then is the DOA for the useful signal 20 with respect to the frontal direction 34. Now, for performing a noise reduction using the first local front signal 10, the first local rear signal 14, the second local front signal 24, and the second local rear signal 28, by beamforming techniques, first of all, the DOA of the useful signal 20, i. e. its angle alpha, is estimated. This may be done by a method known in the art, for example by taking interaural level and/or phase differences that may be inferred from the first and second local front and rear signals 10, 14, 24, 28. Assuming that the DOA alpha of the useful signal 20 is no more than 75° with respect to the frontal direction 34, a first frequency range 40 is assigned such that the first frequency range 40 contains all the frequencies above 1.5 kHz that are treated by the binaural hearing aid 4. Likewise, a second frequency range 42 is assigned as the frequency range from 0 to 1.5 kHz. In the first local unit 1, a first range beamformer signal 44 is generated in a way yet to be described, from the first main signal 18, the second main signal 32 and the first local rear signal 14 as a first auxiliary signal. Furthermore, in the first local unit 1 for the second frequency range 42, a second range beamformer signal 46 is generated in a way yet to be described from the first main signal 18 and the second main signal. 32.

The first range beamformer signal, 44, and the second range beamformer signal 46 of the local unit one are then combined together and possibly treated with some further signal processing 48, such as frequency-dependent amplification for correcting a hearing impairment of the user of the binaural hearing aid 4, leading to a first local output signal 50, which is converted into a first output sound 52 by a first output transducer 54 of the first local unit. In an equivalent way, a second local output signal 56 may be derived from the first main signal 18, the second main signal 32 and the second local rear signal 28, as a second auxiliary signal, using equivalent signal processing steps in the first frequency range 40 and the second frequency range 42 as the ones shown for the local unit 1. For the sake of simplicity, however, these steps are omitted in the drawing of FIG. 1.

FIG. 2 shows, in a schematical top view, how to set spatial conditions on the first range beamformer signal of FIG. 1. In an acoustic scene with a user 60 of the binaural hearing aid 4, as shown in FIG. 1, in the center, a useful signal 20 has an estimated DOA of alpha with respect to the frontal direction 34. The source 36 of the useful signal 20 shall be given by a speaker with which the user 60 is holding a conversation. Due to small head movements of the user 60 during conversation as typical gestures, but also possibly due to small estimation errors due to a noisy background of the acoustic scene, the estimated DOA alpha may not be perfectly aligned with the "true" DOA. Therefore, the first range beam former signal 44 is constructed by imposing certain spatial conditions onto its resulting directional characteristics such that in the first frequency range of FIG. 1, i.e., for frequencies≥1.5 kHz, a higher robustness against small or moderate deviations in the estimated DOA from its true value is achieved.

To this end, a first angle $\alpha 1=\alpha+5°$ and a second angle $\alpha 2=\alpha-5°$ are set with respect to the DOA $\alpha$, at which the attenuation is fixed to be 0 dB, i.e., the resulting first range beamformer signal derived from the first main signal 18, the second main signal 32 and the first auxiliary signal 14 (given by the first local rear signal) does not show any attenuation of an incoming signal in the first frequency range≥1.5 kHz at the first angle $\alpha 1$ and at the second angle $\alpha 2=\alpha-5°$. Thus, small head movements or also estimation errors for the DOA will likely stay in this range of +/−5° about the estimated DOA. By construction, for directed sound with a DOA between $\alpha 1$ and $\alpha 2$, any attenuation that may occur in the first frequency range will be negligible, while sound coming from significantly outside of the cone spanned by $\alpha 1$ and $\alpha 2$ will be treated as noise and will get attenuated. The first range beamformer signal may be constructed from the first main signal 18, the second main signal 32 and the first auxiliary signal 14 by a linear constraint minimum variance beamformer.

FIG. 3 shows, in a schematical top view, how to set the spatial conditions on the second range beamformer signal of FIG. 1. For a true DOA in a range of +/−75° with respect to the frontal direction 34, and assuming only a small or moderate deviation in the estimated DOA from its true value, e.g., up to some +/−5°, the directionality of a useful signal 20 in the second frequency range is less established, so the robustness can be achieved by taking the estimated DOA as the reference value for the spatial condition, i.e., setting a third angle $\alpha 3=\alpha$, and imposing that no attenuation shall occur at $\alpha 3$ in the resulting second range beamformer signal. The consequences of small head movements or estimation errors for the DOA are negligible by construction in the second frequency range, as the useful sound is less directed there. The second range beamformer signal may be constructed from the first main signal 18 and the second main signal 32 via a minimum variance distortionless response beamformer.

In case that the estimated DOA is close to a lateral direction, i.e., $\alpha \in [+/-90°-15°, +/-90°+15°]$, then the first frequency range is preferably set as the frequencies below 500 Hz, while the second frequency range is preferably set as the frequencies above 500 Hz. The process as shown in the FIGS. 1 to 3 can then be applied equivalently.

Even though the invention has been illustrated and described in detail with help of a preferred embodiment example, the invention is not restricted by this example. Other variations can be derived by a person skilled in the art without leaving the extent of protection of this invention.

REFERENCE NUMERAL

1 first local unit
2 second local unit
4 binaural hearing aid
6 first front input transducer
8 first rear input transducer
10 first local front signal
12 environment sound
14 first local rear signal
16 first local beamformer
18 first main signal
20 useful signal
22 second front input transducer
24 second local front transducer
26 second rear input signal
28 second rear input signal
30 second local beamformer
32 second main signal
34 frontal direction
36 source (of useful signal)
38 first frequency range
40 second frequency range
42 first range beamformer signal
44 second range beamformer signal
46 signal processing
48 first local output signal
50 first output sound
52 first output transducer
54 second local output signal
56 user
$\alpha$ DOA
$\alpha 1$, $\alpha 2$, $\alpha 3$ first/second/third angle

The invention claimed is:

1. A method for beamforming in a binaural hearing aid, the binaural hearing aid including a first local unit and a second local unit, the method comprising the following steps:

generating a first main signal and a first auxiliary signal in the first local unit from an environment sound, and generating a second main signal in the second local unit from the environment sound, estimating a direction of arrival of a useful sound signal in the environment sound, assigning a first frequency range and a second frequency range, generating a first range beamformer signal in the first frequency range from the first main signal, the first auxiliary signal and the second main signal by imposing at least one spatial condition related to the estimated direction of arrival on the directional characteristic of the first range beamformer signal, generating a second range beamformer signal in the second frequency range from the first main signal and the second main signal by imposing at least one spatial condition related to the estimated direction of arrival on the directional characteristic of the second range beamformer signal, deriving a first local output signal from the first range beamformer signal and the second range beamformer signal, the first local output signal being transduced into a first output sound by a first output transducer of the first local unit, in the first local unit:

generating a first local front signal from the environment sound by using a first front input transducer, and generating a first local rear signal from the environment sound by using a first rear input transducer, in the second local unit:

generating a second local front signal from the environment sound by using a second front input transducer, and generating a second local rear signal from the environment sound by using a second rear input transducer, generating the first main signal from the first local front signal and the first local rear signal, generating the second main signal from the second local front signal and the second local rear signal, and generating the first auxiliary signal either from the first local front signal or from the first local rear signal.

2. The method according to claim 1, wherein, in order to generate the first range beamformer signal, a first attenuation value at a first angular distance from the estimated direction of arrival and a second attenuation value at a second angular distance from the estimated direction of arrival are given as the at least one spatial condition on the directional characteristic of the first range beamformer signal.

3. The method according to claim 2, wherein the first attenuation value and the second attenuation value are set such that in a first angular range given from 3° to 10° with respect to the estimated direction of arrival, there exists a first angle with an attenuation of less than 0.5 dB, and in a second angular range given from −3° to −10° with respect to the estimated direction of arrival, there exists a second angle with an attenuation of less than 0.5 dB.

4. The method according to claim 1, wherein in order to generate the second range beamformer signal, a third attenuation value at a third angular distance from the estimated direction of arrival is given as the at least one spatial condition on the directional characteristic of the second range beamformer signal.

5. The method according to claim 4, wherein the third attenuation value is set such that in a third angular range given from −2° to 2° with respect to the estimated direction of arrival, there exists a third angle with an attenuation of less than 0.5 dB.

6. The method according to claim 1, wherein the first frequency range and the second frequency range are assigned in dependence of the estimated direction of arrival.

7. The method according to claim 6, wherein for the direction of arrival being estimated in an angular range from a negative aperture angle to a positive aperture angle, each of which are defined with respect to a frontal direction that is defined by the positions of the first local unit and the second local unit, a first crossover frequency is assigned, the first frequency range is assigned as the frequency range above the first crossover frequency and the second frequency range is assigned as the frequency range below the first crossover frequency.

8. The method according to claim 7, wherein the first crossover frequency is assigned as a frequency between 250 Hz and 2 kHz.

9. The method according to claim 7, wherein for the direction of arrival being estimated in an angular range of twice the complementary angle to the positive aperture angle around a lateral direction defined by the positions of the first local unit and the second local unit, a second crossover frequency is assigned, the first frequency range is assigned as the frequency range below the second crossover frequency and the second frequency range is assigned as the frequency range above the second crossover frequency.

10. The method according to claim 9, wherein the second crossover frequency is assigned as a frequency between 250 Hz and 2 kHz.

11. The method according to claim 7, wherein the negative aperture angle is chosen from an angular range of [−85°, −65° ], and the positive aperture angle is chosen from an angular range of [65°, 85° ] with respect to the frontal direction.

12. The method according claim 1, wherein in the first local unit, a first spatial reference signal is generated from the first local front signal or the first main signal, wherein in the first frequency rage range, a first coherence parameter of the first range beamformer signal and the first spatial reference signal is calculated, and a first mixing parameter is derived from the first coherence parameter, wherein a first range output signal is generated by mixing the first range beamformer signal and the first spatial reference signal according to the first mixing parameter, and wherein the first local output signal in the first frequency range is generated from the a first range output signal.

13. The method according claim 1, wherein in the first local unit, a second spatial reference signal is generated from the first local front signal or the first main signal, wherein in the second frequency rage range, a second coherence parameter of the second range beamformer signal and the second spatial reference signal is calculated, and a second mixing parameter is derived from the second coherence parameter, wherein a second range output signal is generated by mixing the second range beamformer signal and the second spatial reference signal according to the second mixing parameter, and wherein the first local output signal in the second frequency range is generated from the a second range output signal.

14. The method according to claim 1, wherein the first range beamformer signal is generated from the first main signal, the first auxiliary signal and the second main signal via a linear constraint minimum variance beamformer, and/or the second range beamformer signal is generated from the first main signal and the second main signal via a minimum variance distortionless response beamformer.

15. A binaural hearing aid, comprising a first local unit with at least a first input transducer for converting environment sound into at least one first input signal, and a second local unit with at least a second input transducer for converting the environment sound into at least one second input signal, and a signal processing unit configured to perform the method according to claim 1.

16. A method for beamforming in a binaural hearing aid, the binaural hearing aid including a first local unit and a second local unit, the method comprising the following steps:

generating a first main signal and a first auxiliary signal in the first local unit from an environment sound, and generating a second main signal in the second local unit from the environment sound, estimating a direction of arrival of a useful sound signal in the environment sound, assigning a first frequency range and a second frequency range, generating a first range beamformer signal in the first frequency range from the first main signal, the first auxiliary signal and the second main signal by imposing at least one spatial condition related to the estimated direction of arrival on the directional characteristic of the first range beamformer signal, generating a second range beamformer signal in the second frequency range from the first main signal and the second main signal by imposing at least one spatial condition related to the estimated direction of arrival on the directional characteristic of the second range beamformer signal, deriving a first local output signal from the first range beamformer signal and the second range beamformer signal, the first local output signal being transduced into a first output sound by a first output transducer of the first local unit, assigning the first frequency range and the second frequency range in dependence of the estimated direction of arrival, for the direction of arrival being estimated in an angular range from a negative aperture angle to a positive aperture angle, each of which being defined with respect to a frontal direction defined by the positions of the first local unit and the second local unit:

assigning a first crossover frequency, assigning the first frequency range as the frequency range above the first crossover frequency, and assigning the second frequency range as the frequency range below the first crossover frequency; and for the direction of arrival being estimated in an angular range of twice the complementary angle to the positive aperture angle around a lateral direction defined by the positions of the first local unit and the second local unit:

assigning a second crossover frequency, assigning the first frequency range as the frequency range below the second crossover frequency, and assigning the second frequency range as the frequency range above the second crossover frequency.

17. The method according to claim 16, which further comprises assigning the first crossover frequency as a frequency between 250 Hz and 2 kHz.

18. The method according to claim 16, which further comprises assigning the second crossover frequency as a frequency between 250 Hz and 2 kHz.

19. The method according to claim 16, which further comprises choosing the negative aperture angle from an angular range of [−85°, −65° ], and choosing the positive aperture angle from an angular range of [65°, 85° ] with respect to the frontal direction.

* * * * *